United States Patent [19]

Wirstlin et al.

[11] 4,033,442

[45] July 5, 1977

[54] LOCKING AND RELEASING MECHANISM FOR A VENDING MACHINE

[75] Inventors: Arthur N. Wirstlin, Altoona; Henry J. Albright, West Des Moines, both of Iowa

[73] Assignee: Fawn Engineering Co., Des Moines, Iowa

[22] Filed: Apr. 30, 1976

[21] Appl. No.: 681,913

[52] U.S. Cl. ..... 194/17; 194/1 L

[51] Int. Cl.[2] ..... G07F 5/02

[58] Field of Search ..... 194/1 L, 2, DIG. 3, 194/48, 17, 92, 93; 221/124, 125

[56] References Cited

UNITED STATES PATENTS

| | | | |
|---|---|---|---|
| 3,360,091 | 12/1967 | Baum | 194/2 |
| 3,545,586 | 12/1970 | Wittern | 194/2 |

*Primary Examiner*—Stanley H. Tollberg
*Attorney, Agent, or Firm*—Henderson, Strom & Sturm

[57] ABSTRACT

A mechanism for selectively locking and releasing an actuating device for a vending machine. The actuating device, when unlocked and actuated, releases an item from the vending machine. The locking and releasing mechanism of the invention includes a shaft rotatably connected to the actuating device. A pair of arm members are attached to the shaft, one being rigidly attached and the other being rotatably attached with respect thereto. Springs are provided for biasing the arm members to a first position for locking the actuating device against an abutment surface connected to a frame member. A cam structure associated with the actuating device is provided for rotating the shaft to thereby unlock one of the arm members under certain circumstances. A projection of a coin registering mechanism is provided to cause unlocking of one or both of the arm members when a predetermined amount of money is registered on the coin registering mechanism.

10 Claims, 14 Drawing Figures

LOCKING AND RELEASING MECHANISM FOR A VENDING MACHINE

BACKGROUND OF THE INVENTION

The present invention relates generally to a mechanism for selectively locking or releasing an actuating mechanism for a vending machine, and more particularly to such a locking and releasing mechanism of a mechanical nature.

This invention is particularly concerned with manually operated vending machines of a type having a plurality of purchaser operable selectors each including a pull-out rod and each of which is adapted for manual operation by a purchaser after insertion of the proper amount of coins into the machine to thereby dispense an item from a related column or magazine holding a supply of such items. In such machines, the power necessary for dispensing an item is applied manually by a purchaser, as distinguished from being applied by other means such as an electric motor, for example. One such example of this type of a vending machine is shown in U.S. Pat. No. 3,007,606.

As the vending machine technology has become more sophisticated, it has also tended to become more complex. Because of such complexity, there are more things which can go wrong with the machine; and, consequently, this increases the likelihood of malfunctioning of the machine. Therefore, there is a need for simplified structures in certain instances such as in the area of mechanisms for selectively locking and releasing an actuating mechanism upon the deposit of the proper amount of money into the vending machine.

Some locking and releasing mechanisms lock up the actuating pull rod only after the vending procedure has begun. It has been determined, however, that it would definitely be more desirable to have the actuating mechanism locked up at all times except when the proper amount of money has been deposited in the machine. A primary reason for this is to aid in the dependability of the locking mechanism and to prevent unnecessarily large forces to be exerted against the locking mechanisms. This has the added effect of reducing pilferage; that is, to prevent items from being released from the machine before the proper amount of money has been inserted therein.

SUMMARY OF THE INVENTION

The present invention relates generally to a mechanism for selectively locking or releasing an actuating device for an item vending machine. A frame having an abutment surface thereon has an actuating device connected thereto for releasing an item from the vending machine upon movement of the actuating device. A shaft is connected to the actuating device, and this shaft has one arm member rotatably connected thereto, and another arm member rigidly connected thereto. The arm members serve to lock the actuating means against the abutment surface on the frame when the arm members are in a first position to which they are biased. A coin registering mechanism is also attached to the frame for registering the amount of money deposited in the mechanism. The coin registering mechanism has a projection thereon, and this projection moves to certain locations depending on the amount of money deposited in the machine. When the projection of the coin registering mechanism is spaced from the arm members, then these arm members remain locked.

But when the projection moves to a point adjacent to the arm members, the movement of the actuating device causes the projection to move the arm members and thereby unlock the actuating device. Alternatively, the arm member which is rigidly attached to the shaft may be moved from the locked to the unlocked position by a cam member attached to the actuating device and the arm member rotatably attached to the shaft is unlocked by the projection on the coin registering mechanism as described above. Structures are also provided for varying the price at which unlocking of the actuating mechanism occurs.

An object of the present invention is to provide an improved unlocking and releasing device for an actuating mechanism for a vending machine.

Another object of the present invention is to provide a locking and releasing device for an actuating mechanism which is of a simplified form for the purpose of enhancing the dependability thereof.

A further object of the invention is to provide a locking and releasing device for an actuating mechanism which locks the actuating mechanism at all times except when the proper coinage has been deposited.

Other objects, advantages, and novel features of the present invention will become apparent from the following detailed description of the invention when considered in conjunction with the accompanying drawings.

DESCRIPTION OF THE PREFFERED EMBODIMENT

Figure 1:
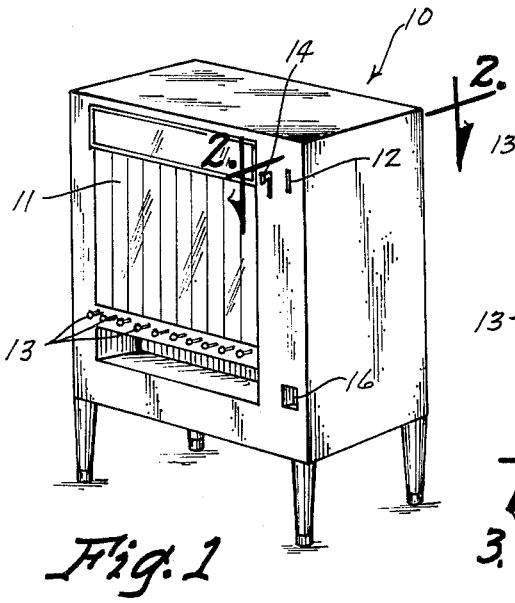
FIG. 1 is a perspective view of a vending machine constructed in accordance with the present invention.

Referring now to the drawings wherein like reference numerals designate identical or corresponding parts throughout the several views, FIG. 1 shows a vending machine 10 constructed in accordance with the present invention. The basic machine 10 shown in FIG. 1 is of a type having a plurality of columns 11 with a number of items stacked therein, such as packages of cigarettes. When the proper amount of money is placed into the coin slot 12, then one of the pull rods 13, having knobs on the ends thereof, can be pulled to thereby release one of the such items, as is well known in this art. If coins are deposited in the coin slot 12 and none of the pull rods 13 have been actuated, then these coins can be returned by pushing down on the coin release lever 14, thereby causing those coins just placed in the slot 12 to be returned into the coin return box 16.

Figure 2:
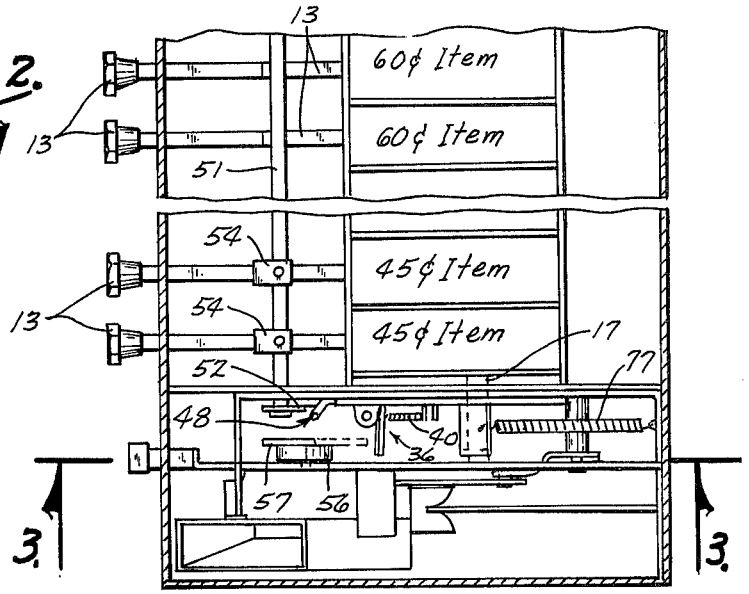
FIG. 2 is a cross-sectional view taken along line 2—2 of FIG. 1.
Figure 4:
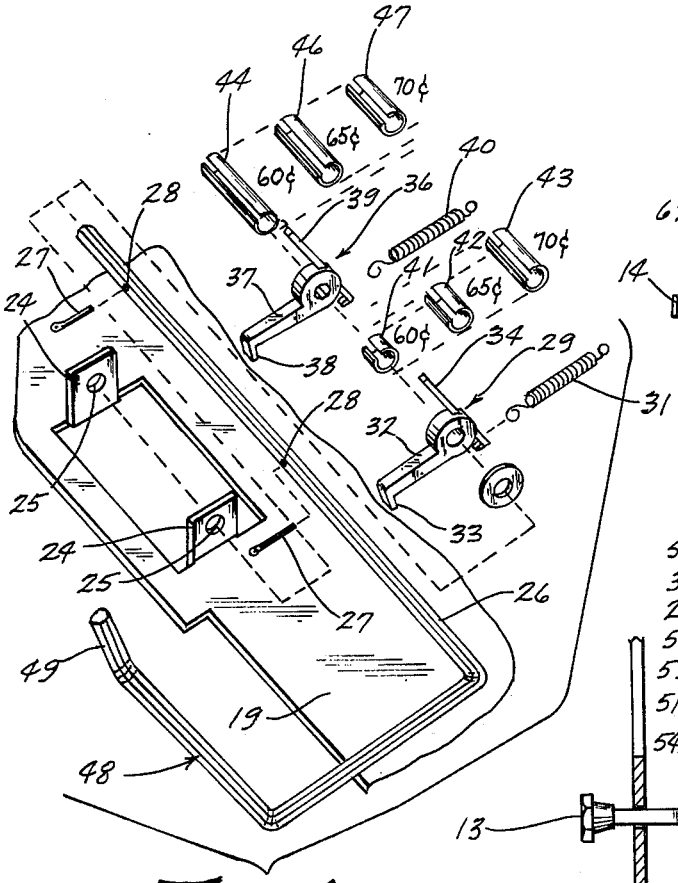
FIG. 4 is an exploded perspective view of the locking mechanism of the present invention.
Figure 3:
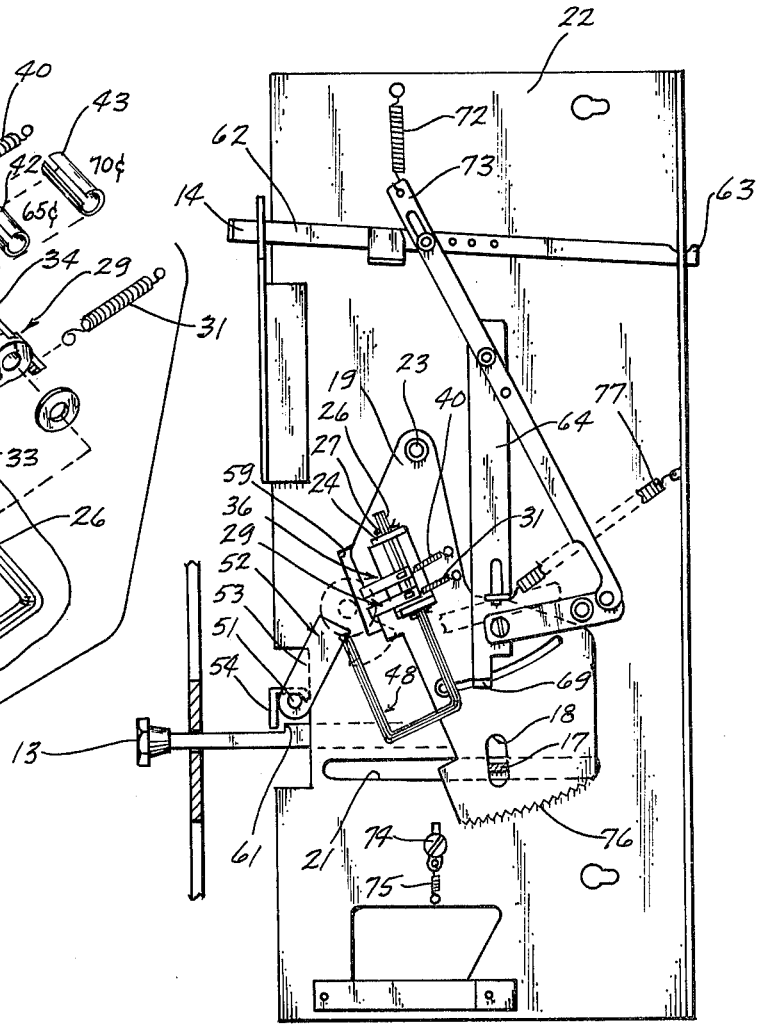
FIG. 3 is a cross-sectional view taken along line 3—3 of FIG. 2.

Referring now in particular to FIGS. 2–4, the pull rods 13 of the actuating mechanism can clearly be seen extending from the inside of the vending machine 10 to the outside thereof. The inner ends of the pull rods 13 are connected to item releasing structures (not shown) which are well known in this art so that no detailed discussion of such structures will be discussed herein, since this invention is directed to a mechanism for locking or releasing the reciprocating movement of the pull rods 13. A transverse member 17 is linked to the actuating mechanism, including the pull rods 13, whereby when one of the pull rods 13 is moved from the position shown in FIGS. 2 and 3 to the fully actuated position shown in FIG. 14, the transverse member 17 is also moved from the position shown in FIGS. 2 and 3 to the position shown in FIG. 14. The transverse member 17 is received through an opening 18 in a plate member 19 and through a slot 21 in the frame 22. The plate member 19 is pivotally attached to the frame 22 by means of a pin 23 (FIG. 3).

Referring now in particular to FIG. 4, it can be seen that the plate member 19 has a pair of upstanding flange members 24 thereon having openings 25 therein. A shaft 26 extends through the openings 25 in the flange members 24, such that the shaft 26 is rotatably received within the openings 25. Cotter keys 27 extend through openings 28 in the shaft 26 to thereby retain the shaft 26 within the openings 25 and rotatably attached to the projections 24.

Figure 5:
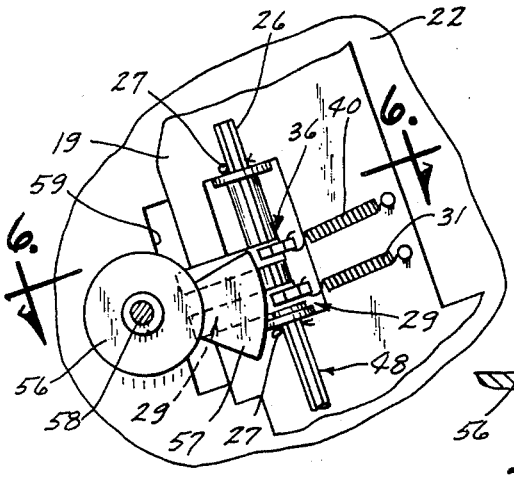
FIG. 5 is a partial view of the locking mechanism of the present invention shown in a position for unlocking and releasing an actuating mechanism.
Figure 13:
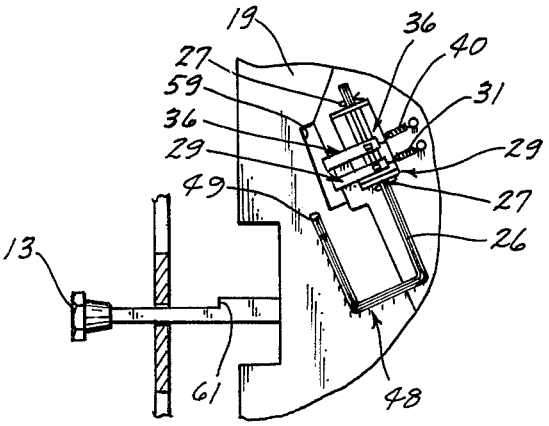
FIG. 13 is a simplified view of the mechanism for selectively locking and releasing the actuating device in side elevation, similar to FIG. 12.

Between the projection members 24 on the shaft 26 is disposed a first arm member 29. This first arm member 29 is rotatably attached to the shaft 26 and is biased to a first position as shown for example in FIGS. 3, 5 and 13 by means of a spring 31. The first arm member 29 includes a first arm 32 having a right angled portion 33 attached thereto and a second arm portion 34 extending in another direction from the first arm member 29.

Figure 6:
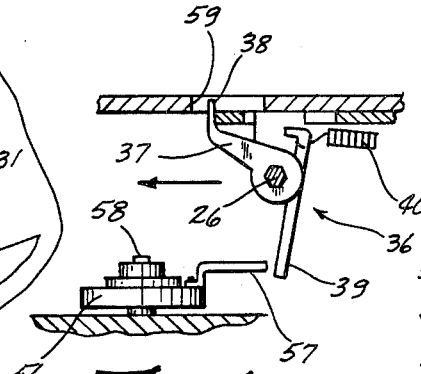
FIG. 6 is a cross-sectional view taken along line 6—6 of FIG. 5.
Figure 7:
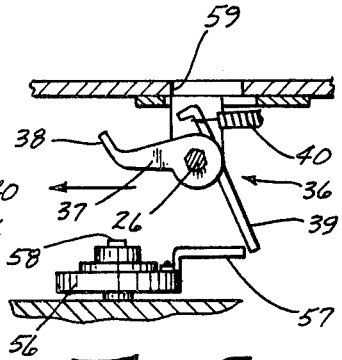
FIG. 7 is a cross-sectional view like FIG. 6, but showing the device when the actuating mechanism is actuated and the locking mechanism is therefore unlocked and released.
Figure 11:
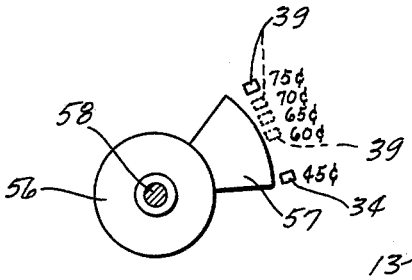
FIG. 11 is a view like FIG. 8, but showing the coin registering having 75 cents registered therein, and further illustrating the fact that the arm members of the device for locking and releasing the actuating mechanism can be adjusted to release only after a predetermined amount of money has been inserted into the coin registering mechanism.

A second arm member 36 is non-rotatably attached to the shaft 26 such that rotation of the shaft 26 effects movement of the second arm movement 36 or that movement of the arm member 36 effects movement of the shaft 26. The second arm member 36 has a first arm portion 37, having a right angled portion 38 attached thereto, and a second arm portion 39. A spring 40 biases second arm member 36 to a first locked position as shown in FIG. 6. Depending upon the price of the item to be dispensed, the spacers 41, 42 and 43 respectively, are spaced on the shaft 26 between the first arm member 29 and the second arm member 36. If the spacer 41 is used, then a spacer 44 will be used between the second arm member 36 and the top flange member 24. If the spacer 42 is used, then the spacer 46 will be used with it and, accordingly, if the spacer 43 is to be used, then the spacer 47 will be used with it between the second arm member 36 and the flange member 34. The effect of using these spacers 41, 42, 43, 44, 46 and 47 can be illustrated easily by viewing FIG. 11 which shows the relative spacing of the second arm portion 39 of the second arm member with respect to the second arm member 34 of the first arm member 29 when the various spacers are used. The member 39 shown in dashed lines indicates where it would be if the 60, 65 or 70 cent spacers are used; and, in solid lines, when the 75 cent spacers (not shown in FIG. 4) would place the second arm member 36 and second arm portion 39 thereof. This structure, including the spacers 41, 42, 43, 44, 46 and 47, constitute a price adjusting mechanism for determining the amount of money required before the actuating pull rod 13 is released and the corresponding item can be dispensed.

An extension member 48 is attached to the shaft 26 and has a turned-up portion on one end thereof. A shaft 51 is rotatably attached to the frame 22 and at selected points has a structure 54 rigidly attached thereto. This rod 51 is biased to the rotary position shown in FIGS. 2 and 3 by a spring (not shown). A cam mechanism 52 connected to one end of rod 51 consists essentially of an upwardly extending portion 53. This cam structure 52 is used in the embodiment disclosed, only with respect to 45 cent items; but they could, of course, be used with any designated amount as a price for an item. This particular structure was, however, designed in the present embodiment to be used with the lowest priced item within a particular vending machine. The operation of this cam device 52 will be explained below.

Referring now to FIGS. 5–11 in particular, a disc 56 is shown having a projection 57 extending therefrom. The disc 57 is rigidly connected to a shaft 58 which is turned by a coin registering mechanism (not shown) such as the type disclosed in U.S. Pat. No. 3,545,586. Many other types of coin registering mechanisms could, however, be used so long as they register by turning a shaft such as the shaft 58 and would thereby control the position of the projection 57 in direct proportion to the amount of money inserted into the vending machine.

Figure 8:
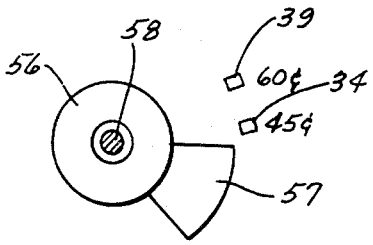
FIG. 8 is a simplified view similar to FIG. 5 and showing the portion of the coin registering mechanism when an insufficient amount of money is registered thereon.

It can be seen in FIG. 8 by the position of the projection 57 that there has not yet been 45 cents registered on the registering device, since the projection 57 is not yet in front of the second arm portion 34 of the first arm member 29. Consequently, the first arm member 29 and the second arm member 36 would both remain in their locking position, for example as shown in FIG. 6, so that when the pull rod 13 is moved from right to left, that the transverse member 17 will pivot the plate member 19 in a clockwise direction; and, when it does this, the portion 33 of the first arm member and the portion 38 of the second arm member will abut the abutment surface 59 (FIGS. 3, 6 and 12) thereby preventing further pivotal movement of the plate member 19 in a counterclockwise direction and thereby preventing any further movement of the pull rod 13 by the right to the left while first and second arm members 29 and 36 are in their locked position.

For explanatory purposes, the FIG. 9 position of the projection 57 will be made after a discussion of the FIG. 10 position. Referring to FIG. 10, it can be seen that a sufficient amount of money has been placed into the machine such that the registering mechanism, only having portions 56, 57 and 58 shown, has responded to this condition and indicates that 60 cents has been inserted. This is true because the projection 57 is in front of and up to the second arm portion 39 of the second arm member 36, and no further. When the projection 57 is in this position and a pull rod 13 is pulled, again the transverse member 17 will follow the pull rod 13 from right to left as shown in FIG. 3, for example. This will cause the plate member 19 to be rotated in a clockwise direction as viewed in the drawings, such that the first and second arm members 29 and 36 respectively will move with the plate member 19. As this movement occurs, with reference to FIGS. 6 and 10, it can be seen that the second arm portions 34 and 39 of the first and second arm members 29 and 36 are moved with the plate member 19 as it moves in a counterclockwise direction, and that they (positions 34 and 39) contact the projection 57 and that this overcomes the bias of the springs 31 and 40 to thereby move the first and second arm members 29 and 36 to the position shown in FIG. 7, although FIG. 7 really only shows the second arm member 36. It is to be understood, however, that if the projection 57 is in the position of FIG. 10, that when the second arm member 36 is in the position shown in FIG. 7 that the first arm member 29 will be in an identical unlocking position. It can be seen that when the arm members 29 and 36 are in the position shown in FIG. 7 that they no longer contact the abutment surface 59 and consequently the plate member 19 is free to pivot around its pivotal point 23. Therefore, the transverse member 23 can move from the position shown in FIG. 3 to the position shown in FIG. 4 by manual movement of the pull rod 13 from the right-most position shown in FIG. 3 to a left-most position shown in FIG. 14, and this movement will release an item from the vending machine. In this particular case, one of the pull rods 13 corresponding to a 60 cent item was pulled so consequently it is a 60 cent item which will be dispensed. An identical operation would occur with respect to any one of the price items shown in FIG. 11 from 60 cents to 75 cents; and, as mentioned above, this price adjusting is accomplished by using spacers to move the second arm member 36 a specified distance along the shaft 26 from the first arm member 29.

Figure 9:
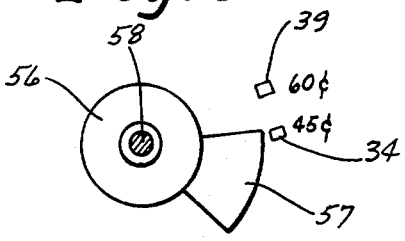
FIG. 9 is a view like FIG. 8, but showing the registering device with 45 cents registered therein.
Figure 10:
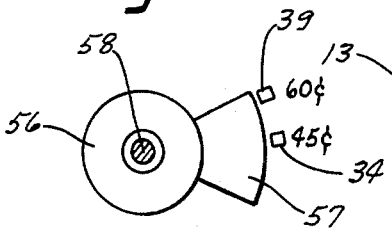
FIG. 10 is a view like FIG. 8, but showing the registering mechanism having 60 cents registered therein.

Referring now to FIG. 9, it can be seen that the coin registering mechanism is registering 45 cents, so that a 45 cent item could be vended without a deposit of more money. It is apparent, however, from looking at the situation in FIG. 9 that the projection 57 is not in a position to unlock the second portion 39 of the second arm member 36, so that if no other structure was provided, then the second arm member 36 would remain locked and the pull rod 13 could not be actuated in order to dispense the 45 cent item.

Figure 12:
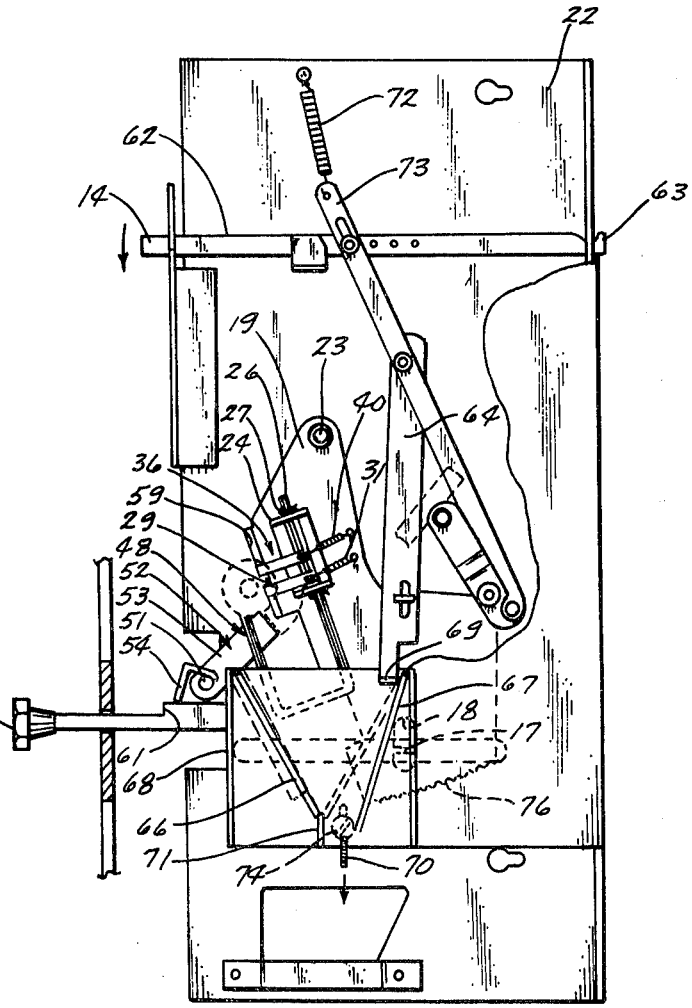
FIG. 12 is a view, like FIG. 3, but showing the actuating mechanism pulled half way out.

Accordingly, further structure has been provided and this structure specifically includes a cam member 52 as discussed above. An upstanding portion 61 (FIG. 3) on the pull rod 13 is designed to abut the downwardly extending portion 54 attached to the rod 51. When this has been done, as shown by the movement of the pull rod 13 from the right-most position as shown in FIG. 3, and moved slightly to the left as shown in FIG. 12, the cam 52 is rotated in a clockwise manner such that the upwardly extending portion 53 of the cam 52 contacts the extension 48 of the shaft 26 and forces the shaft 46 to be rotated in a counterclockwise direction from the position shown in FIG. 6 to the position shown in FIG. 7 of the second arm member 36. Consequently, further movement of the pull rod 13 from the position shown in FIG. 12, to the left-most position shown in FIG. 14, causes the projection 57 to abut the portion 34 of the first arm member and therefore the first arm means 29 is unlocked by the action of the projection 57; and, the second arm member 36 is unlocked by the action of the cam 52 acting on the extension member 48 of the shaft 26.

It is the mechanism for selectively locking and releasing the actuating device of a vending machine which is the subject of this invention; however, certain other structures are shown in the drawings which are of some significance as they relate to the locking and unlocking mechanism. For example, the coin return lever 62 is pivotally attached to the vending machine at the rear end 63 thereof and downward movement of coin return lever 62 caused downward movement of the lever 64. When coins pass through the coin registering mechanism, of which only portions 56, 57 and 58 are shown, these coins remain in a V-shaped space formed between a coin box arm 66 and an escrow coin return arm 67, both of which are pivotally attached to the box-like structure 68. If the coin return lever 62 is moved downwardly from the position shown in FIGS. 3 and 14, to the position shown in FIG. 12, then the bottom end 69 of the lever 64 (FIG. 12) pivots the escrow return arm 67 from the position shown in dashed lines in FIG. 12 to the position shown in solid lines in FIG. 12, thereby releasing the coin 70 and returning it to the customer in the coin return enclosure 16. If, on the other hand, an item is dispensed, pivotal movement of the coin box arm 66 is effected by contact of the transverse member 17 with the coin box arm 56, thereby causing any coins in the V between the coin box arm 66 and the escrow arm 67 to be deposited to the left of the member 71, and into the vending machine coin box (not shown). It can be seen that the coin return lever 62 and its associated linkage is biased to the position shown in FIG. 3 by the action of a tension spring 72 attached to the linkage arm 73 on one end and to the frame 22 on the other end.

Figure 14:
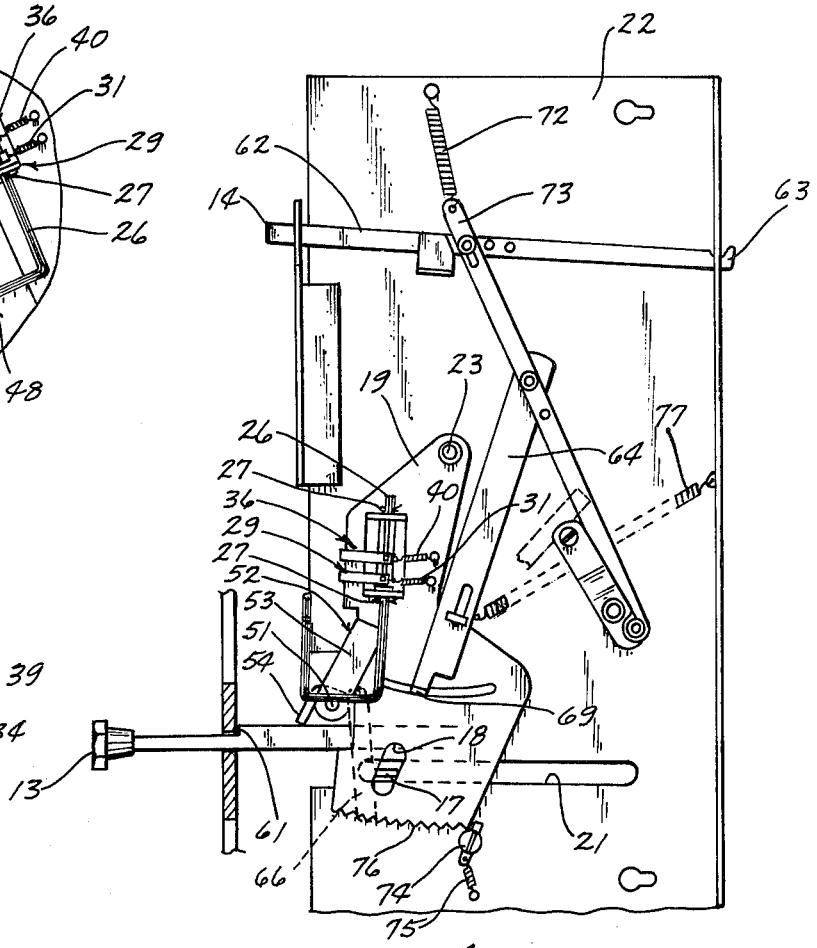
FIG. 14 is a view, like FIG. 3, but showing the actuating device completely actuated.

Referring to FIGS. 3 and 14, it can be seen that a locking member 74 is biased to the position shown in FIG. 3 by a tension spring 75. As the pull rod is moved from right to left from the FIG. 3 position to the FIG. 14 position, the locking member 14 engages the teeth 76 on the plate member 19. Once this engagement occurs, the pull rod 13 cannot be moved back to the right until and unless a complete vend occurs; that is, until the teeth portion 76 of the lever 19 pass to the left of the locking member 74. Once this occurs, then the lever 19 can return back to the position shown in FIG. 3, and will so return because of the action of the tension spring 77.

Obviously, many modifications and variations of the present invention are possible in light of the above teachings. It is therefore to be understood that, within the scope of the appended claims, the invention may be practiced otherwise than as specifically described.

We claim:

1. A mechanism for selectively locking and releasing an actuating means for an item vending machine comprising:

a frame having an abutment surface thereon;

actuating means connected to said frame for releasing an item from said vending machine upon movement of said actuating means from a first position to a second position;

a plate member movably attached to said frame;

means for operatively linking said plate member to said actuating means whereby movement of the actuating means causes movement of the plate member;

a shaft connected to said plate member;

arm means connected to said shaft and having a first pivotal position wherein one end of said arm means is in juxtaposition with a portion of said plate member on one side of said one end, and in juxtaposition to said abutment surface on the other side of said one end thereof whereby said actuating means is locked from substantial movement, said arm means having a second pivotal position spaced from said abutment surface for unlocking said actuation means;

biasing means for biasing said arm means to said first pivotal locking position;

coin registering means attached to said frame for registering the amount of money deposited in the mechanism, said coin registering means having a projection means thereon, said projection means moving to specific locations upon deposit of specific amounts of money deposited in the mechanism, said projection means being spaced from said arm means in one position thereof for maintaining said actuating means in a locking position and being adjacent to said arm means in a second position thereof for unlocking said actuating means by allowing movement of the actuating means to move the arm means against said projection means, thereby pivoting said arm means to said second position thereof away from said abutment surface.

2. The mechanism as defined in claim 1 wherein said arm means is pivotally attached to said shaft.

3. The mechanism as defined in claim 2 further comprising:

second arm means rigidly attached to said shaft and having a first pivotal position wherein one end of said second arm means is in juxtaposition with a portion of said plate member on one side of said one end of said second arm means and in juxtaposition to said abutment surface on the other side of said one end thereof wherey said actuating means is further locked from substantial movement, said second arm means having a second pivotal position spaced from said abutment surface for unlocking of said actuation from said second arm means, said shaft being rotatably mounted to said plate member.

4. The mechanism as defined in claim 3 further comprising:

extension means connected to said shaft;

cam means operatively connected to said frame for contacting said extension means to thereby rotate said shaft and said second arm means upon movement of said actuating means from the first to the second position thereof.

5. The mechanism as defined in claim 3 wherein said projection means is spaced from said second arm means in said one position thereof and is adjacent to said second arm means in said second position thereof.

6. The mechanism as defined in claim 1 including means for varying the price at which said mechanism unlocks said actuating means comprising means for varying the position of said arm means on said shaft.

7. The mechanism of claim 4 wherein said actuating means includes a pull rod.

8. The mechanism of claim 7 wherein said cam means comprises a cam member pivotally attached to said frame, a projection being disposed on said pull rod whereby longitudinal movement of said pull rod causes pivotal movement of said cam member.

9. A mechanism as defined in claim 1 wherein said arm means comprises a member having two arms thereon, the first of said arms being for selectively contacting said abutment surface and the second of said arms being for selectively contacting the projection means of said coin registering means.

10. The mechanism of claim 1 wherein said plate member is pivotally attached to the frame.

* * * * *